US011059642B2

(12) United States Patent
Dais et al.

(10) Patent No.: US 11,059,642 B2
(45) Date of Patent: Jul. 13, 2021

(54) PACKAGING DEVICE

(71) Applicant: S. C. Johnson & Son, Inc., Racine, WI (US)

(72) Inventors: Brian C. Dais, Sanford, MI (US); Brian T. Davis, Burlington, WI (US); Jose Porchia, Saginaw, MI (US); Rajarajan Ravichandran, Kenosha, WI (US); Jennifer Shcherban, Chicago, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 34 days.

(21) Appl. No.: 16/389,448

(22) Filed: Apr. 19, 2019

(65) Prior Publication Data

US 2020/0331679 A1 Oct. 22, 2020

(51) Int. Cl.
*B65D 73/00* (2006.01)

(52) U.S. Cl.
CPC ..... *B65D 73/0021* (2013.01)

(58) Field of Classification Search
CPC ..... B65D 73/0021; B65D 73/0064; B65D 73/0078; B65D 77/02; B65D 73/0014; B65D 73/005; B65D 73/0042; B65D 73/0085
USPC ..... 206/362.4, 779, 299, 460–471
See application file for complete search history.

(56) References Cited

U.S. PATENT DOCUMENTS 2,117,497 A * 5/1938 Owens ..... H05B 31/16 423/448
2,401,615 A * 6/1946 Chittum ..... B65D 73/0021 40/124.18
2,755,924 A * 7/1956 Tuttle ..... B65D 85/18 206/296
3,009,622 A 11/1961 Leone
3,314,530 A * 4/1967 Michalka ..... B65D 5/504 206/756
3,375,921 A 4/1968 Ligon
3,990,578 A * 11/1976 Roeser ..... B65D 73/0085 206/461
4,549,654 A 10/1985 Tiesman
5,697,502 A * 12/1997 Linz ..... B65D 73/0085 206/779
5,791,470 A * 8/1998 Usui ..... B65D 73/0014 206/362.4

(Continued)

FOREIGN PATENT DOCUMENTS

DE 9115563 * 12/1991 ..... B65D 73/0021
WO 2016064975 A1 4/2016
WO 2018156233 A1 8/2018

*Primary Examiner* — Chun Hoi Cheung

(57) ABSTRACT

A packaging device includes a first portion and a second portion connected to the first portion by way of a first fold line. The first portion includes a first primary edge opposite the first fold line. First and second secondary edges extend between the first fold line and the first primary edge, and an attachment mechanism is provided adjacent the first primary edge. The second portion includes a second primary edge opposite the first fold line. Third and fourth secondary edges extend between the first fold line and the second primary edge. An arm is defined by two cut lines extending from a section of the second portion closer to the first fold line than the second primary edge, and ending in a tab that extends beyond a distal end of the second primary edge.

27 Claims, 15 Drawing Sheets

(56) References Cited

U.S. PATENT DOCUMENTS

| | | | | |
|---|---|---|---|---|
| 6,032,793 | A * | 3/2000 | Oakley | B65D 73/0064 206/296 |
| 6,622,858 | B1 * | 9/2003 | Wilkinson | B65D 73/0078 206/299 |
| 6,808,069 | B1 * | 10/2004 | O'Toole | B65D 73/0021 206/15.3 |
| 7,311,197 | B1 | 12/2007 | Wilkinson et al. | |
| 8,052,103 | B2 | 11/2011 | Ferraro et al. | |
| 8,281,927 | B2 | 10/2012 | Smith | |
| 8,875,872 | B2 | 11/2014 | Bulls, Jr. | |
| 9,162,789 | B2 | 10/2015 | Beyer et al. | |
| 9,162,792 | B2 | 10/2015 | James et al. | |
| 9,346,596 | B2 * | 5/2016 | Hanks | B65D 73/0035 |
| 9,656,783 | B2 | 5/2017 | Lyzenga et al. | |
| 9,688,442 | B2 | 6/2017 | Lyzenga et al. | |
| 9,708,104 | B2 | 7/2017 | Lyzenga et al. | |
| 9,828,131 | B2 | 11/2017 | James et al. | |
| 2004/0050751 | A1 * | 3/2004 | Hood | B65D 73/0021 206/581 |
| 2008/0073387 | A1 * | 3/2008 | Godfrin | A47F 7/10 223/87 |
| 2013/0327673 | A1 * | 12/2013 | Hanks | B65D 73/0085 206/488 |
| 2016/0039590 | A1 | 2/2016 | Beyer et al. | |
| 2016/0107814 | A1 | 4/2016 | Fitzwater et al. | |
| 2017/0233158 | A1 | 8/2017 | Lyzenga et al. | |
| 2018/0244452 | A1 | 8/2018 | Huffer | |

* cited by examiner

PACKAGING DEVICE

FIELD OF THE DISCLOSURE

Embodiments of the present disclosure generally relate to packaging devices, and, more particularly packaging devices that secure, display, and protect products while providing consumers with the opportunity to feel the products.

BACKGROUND

As the consumer products industry grows more competitive, consumer product manufacturers seek methods to outperform their competitors in various ways. One approach used by manufacturers to improve sales is to advertise their products in an enhanced light. Specifically, manufacturers attempt to improve product packaging and display with the hope of positively impacting a product's sales.

A product's packaging is what initially attracts customers. Branding, customized coloration, and patterning often allow the package to catch a customer's eye; however, such indicia are not always enough to convince a customer to purchase a product. Customers desire reassurance that they are purchasing a high-quality product, and, commonly, want to see and feel a product before purchase. U.S. Patent Application Publication 2016/0107814 discloses a packaging device for holding a product and includes a liner for wrapping around the product and a construct for wrapping around the liner. This method of packaging may secure the contents held therein, but it may do so at the expense of providing the opportunity for customers to feel the packaged product. Therefore, there is a need for a packaging device that secures, displays, and protects products while providing consumers with the opportunity to feel the products.

The display of a product's package can also substantially impact its sales. It is not uncommon to see products displayed in an aisle of a store that are misplaced, haphazardly placed or arranged on a shelf, or otherwise projecting a cluttered appearance to a consumer. For example, accessories aisles at consumer product retail stores commonly include several brands selling similar products, and, as a result, the aisles are cluttered and difficult to maneuver. Poorly configured aisles also become an issue when a brand offers several versions of a product. When stacking or hanging a group of packaged products, the packages near the bottom or back of the group are difficult to see or access. Thus, a need exists for displaying packages in a way that is easy to maneuver and access. Additionally, there is a need for a packaging device that is configured to be accommodated by both a display tray and a rack hook so that display capacity can be enhanced.

SUMMARY

In one aspect, a packaging device includes a first portion and a second portion foldably connected to the first portion by way of a first fold line. The first portion includes a first primary edge opposite the first fold line, wherein first and second secondary edges extend between the first fold line and the first primary edge, and wherein an attachment mechanism is provided adjacent the first primary edge. The second portion includes a second primary edge opposite the first fold line, wherein third and fourth secondary edges extend between the first fold line and the second primary edge. An arm is defined by two cut lines extending from a section of the second portion closer to the first fold line than the second primary edge, and ending in a tab that extends beyond a distal end of the second primary edge.

In another aspect, a packaging device includes a first portion and a second portion connected to the first portion by way of a first fold line. The first portion includes a first primary edge opposite the first fold line, wherein first and second secondary edges extend between the first fold line and the first primary edge, and an attachment mechanism is provided adjacent the first primary edge. The second portion includes a second primary edge opposite the first fold line, wherein third and fourth secondary edges extend between the first fold line and the second primary edge. An arm is defined by two cut lines extending from a section of the second portion closer to the first fold line than the second primary edge, and ending in a tab that extends beyond a distal end of the second primary edge. Additionally, first, second, third, and fourth notches are provided on the first, second, third and fourth secondary edges, respectively.

In yet another aspect, a packaging device includes a first portion and a second portion foldably connected to the first portion by way of a first fold line. The first portion includes a first primary edge distal and parallel to the first fold line, first and second secondary edges perpendicular to the first fold line, first and second notches provided along the secondary edges, and a perforated arcuate cut adjacent to the first primary edge. The second portion includes a second primary edge distal and parallel to the first fold line, third and fourth secondary edges perpendicular to the first fold line, and third and fourth notches provided along the secondary edges symmetric to the first and second notches about the first fold line. The second portion further includes an arm defined by two perforated cut lines extending from a section of the second portion closer to the first fold line than the second primary edge, and ending in a tab that extends beyond a distal end of the second primary edge, the tab having two side edges perpendicular to the second primary edge and one end edge parallel to the second primary edge, wherein the two side edges are provided collinearly with the two perforated cut lines.

Figure 1:
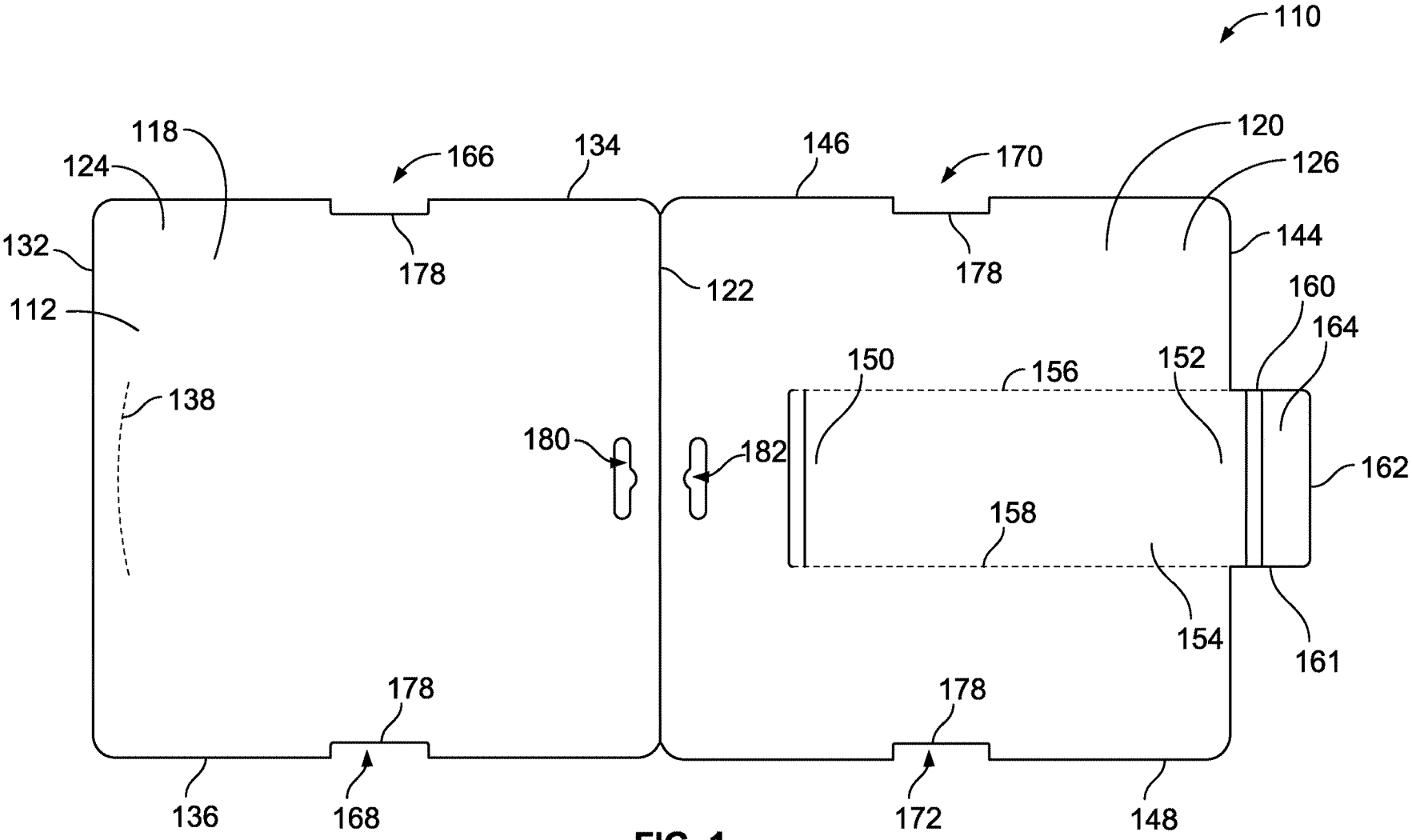
FIG. 1 illustrates a front view of a packaging device assembly in an unassembled state, according to the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DRAWINGS

FIG. 1 illustrates a packaging device 110 in an unfolded state. A blank 112 of the packaging device 110 includes a first portion 118 and a second portion 120 foldably connected to the first portion 118 by way of a first fold line 122. In the shown unfolded state, the blank 112 includes a first outer surface 124 on the first portion 118 coplanar with a first outer surface 126 on the second portion 120. As an alternative to the first portion 118 and second portion 120 being connected by way of the first fold line 122, one of ordinary skill in the relevant art would appreciate that the first portion and second portion may be connected by other methods including, e.g., a living hinge, or a perforation. Still further, the packaging device may include only one of the first portion or the second portion, with the elements of the eliminated portion discussed below being incorporated into the remaining portion.

The first portion 118 includes a first primary edge 132 substantially parallel and opposite the first fold line 122. First and second secondary edges 134, 136 extend between the first fold line 122 and the first primary edge 132 and may be substantially perpendicular to the first fold line 122. An attachment mechanism 138 is provided adjacent the first primary edge 132. In the present aspect, the attachment mechanism 138 is an arcuate perforated cut that is convex when viewed from the first primary edge 132; however, other aspects may provide attachment mechanisms of different shapes and sizes or no attachment mechanism at all.

The second portion 120 includes a second primary edge 144 opposite and substantially parallel to the first fold line 122. Further, third and fourth secondary edges 146, 148 extend between the first fold line 122 and the second primary edge 144 and may be substantially perpendicular to the first fold line 122.

In one aspect, the first and second portions 118, 120 may have substantially the same length, i.e., the distance from the first fold line 122 to the first primary edge 132 may be substantially equal to the distance from the first fold line 122 to the second primary edge 144. Alternatively, one of the first or second portions 118, 120 may be noticeably longer than the other portion.

In another aspect, the first and second secondary edges 134, 136 and/or the third and fourth secondary edges 146, 148 may not be substantially perpendicular to the first fold line 122, i.e., substantially parallel to one another. For example, one or both of the first portion 118 and second portion 120 may form a parallelogram or trapezoid. In such situations, the secondary edges may be oriented such that the first and third secondary edges 134, 146 and the second and fourth secondary edges 136, 148, respectively, may be aligned when one of the first and second portions 118, 120 is folded along the fold line 122 to bring those portions into contact with one another.

Returning to FIG. 1, the second portion 120 may define at least a portion of an arm 154 having a proximal end 150 disposed proximate the first fold line 122 and a distal end 152 spaced away from the proximal end 150. First and second perforated cut lines 156, 158 defining a width of the arm 154 and enabling separation of the arm 154 from a remainder of the second portion 120 extend from the proximal end 150 to the second primary edge 144. The arm 154 may include a tab 164 at the distal end 152 that extends outward of the second primary edge 144. The tab 164 may include two side edges 160, 161 substantially perpendicular to the second primary edge 144 and substantially collinear to the first and second perforated cut line 156, 158. The arm further includes an end edge 162 at the distal end 152. In one aspect, the end edge 162 may be substantially parallel to the second primary edge 144. In another aspect, the end edge 162 may be convex or pointed to facilitate insertion into the attachment mechanism 138.

In one aspect, the arm 154 may be centrally disposed between the third and fourth secondary edges 146, 148. The arm 154 may have a width large enough to hold products securely when in a closed configuration (as discussed in greater detail below). For example, the arm 154 may be between about 20% and about 50% of a width of the second portion 120, or between about 25% and about 40% of the width of the second portion 120, and in one aspect, about 33% of the width of the second portion 120.

FIG. 1 depicts the arm 154 in an original position. Although the arm 154 in the present embodiment is defined by the first and second perforated cut lines 156, 158, other embodiments may provide the arm 154 being defined by two completely severed cut lines. In one embodiment, the arm can be adhesively releasable. In another embodiment, the arm can be an entirely separate piece secured to the second portion by a securing method, such adhesive, fasteners, hook and loop fasteners, or any other appropriate method. In still another embodiment, the arm may not be secured to the first or second portions of the packaging device at all. For example, the proximal end 150 may be separate from the second portion 122, and the latter may include a second attachment mechanism similar to the attachment mechanism 138 configured to receive that proximal end 150.

The packaging device 110 further may include first and second notches 166, 168 provided along the first and second secondary edges 134, 136 of the first portion 118, respectively. Similarly, third and fourth notches 170, 172 may be provided along the third and fourth secondary edges 146, 148 of the second portion 120, respectively, and may be symmetrical with the first and second notches 166, 168 about the first fold line 122. Each of the notches 166, 168, 170, 172 may include an end edge 178 substantially perpendicular to the first fold line 122. Although the present embodiment discloses first, second, third, and fourth notches, additional embodiments of the present disclosure may include more notches, fewer notches, or no notches at all.

Additionally, the packaging device 110 may include first and second scalloped cutouts 180, 182 located adjacent to the first fold line 122 on the first and second portions 118, 120, respectively. The cutouts 180, 182 may be provided to assist in hanging the packaging device 110 on pegs or hangers for display. Although the present embodiment includes the first and second scalloped cutouts 180, 182, additional embodiments may elect not to include them, or opt to include cutouts of differing sizes and/or shapes.

Figure 2:
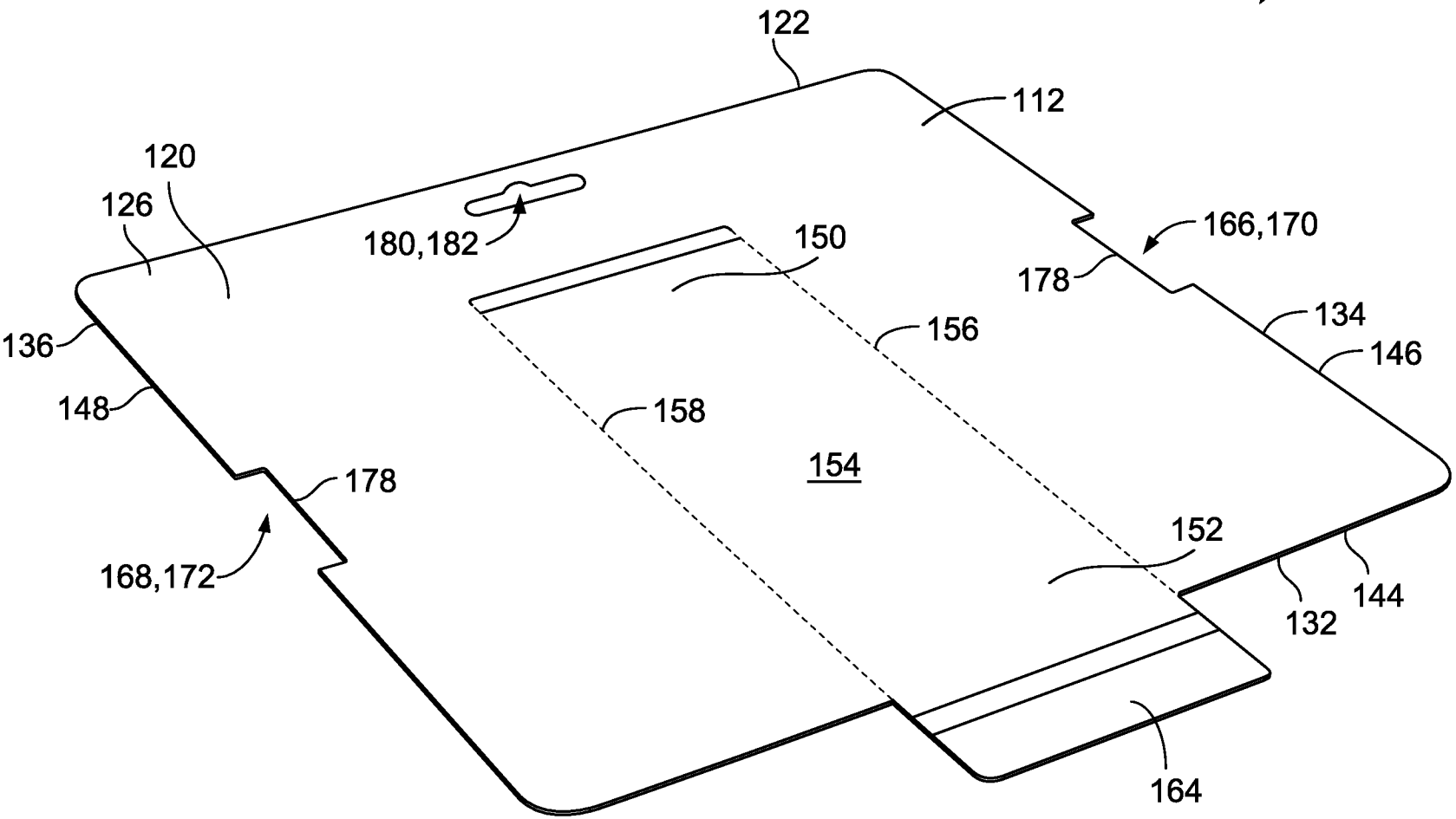
FIG. 2 illustrates an isometric view of the packaging device of FIG. 1 in a partially assembled state.

FIG. 2 depicts the packaging device 110 in a folded state, in which the blank 112 is folded about the first fold line 122 so that the first outer surface 124 of the first portion 118 and the second outer surface 126 of the second portion 120 face opposite directions. Further, the first and second notches 166, 168 of the first portion 118 may align with the third and fourth notches 170, 172 of the second portion 120, respectively, and the first and second scalloped cut outs 180, 182 may align with each other. The packaging device 110 may be secured in the folded state with an adhesive, such as glue or tape. Alternatively, the packaging device 110 may be secured without an adhesive by way of fasteners, additional folding, or any other appropriate method. In the folded state, each of the first primary edge 132, the first secondary edge 134, and the second secondary edge 136 may align with the second primary edge 144, third secondary edge 146, and fourth secondary edge 148, respectively.

Figure 3:
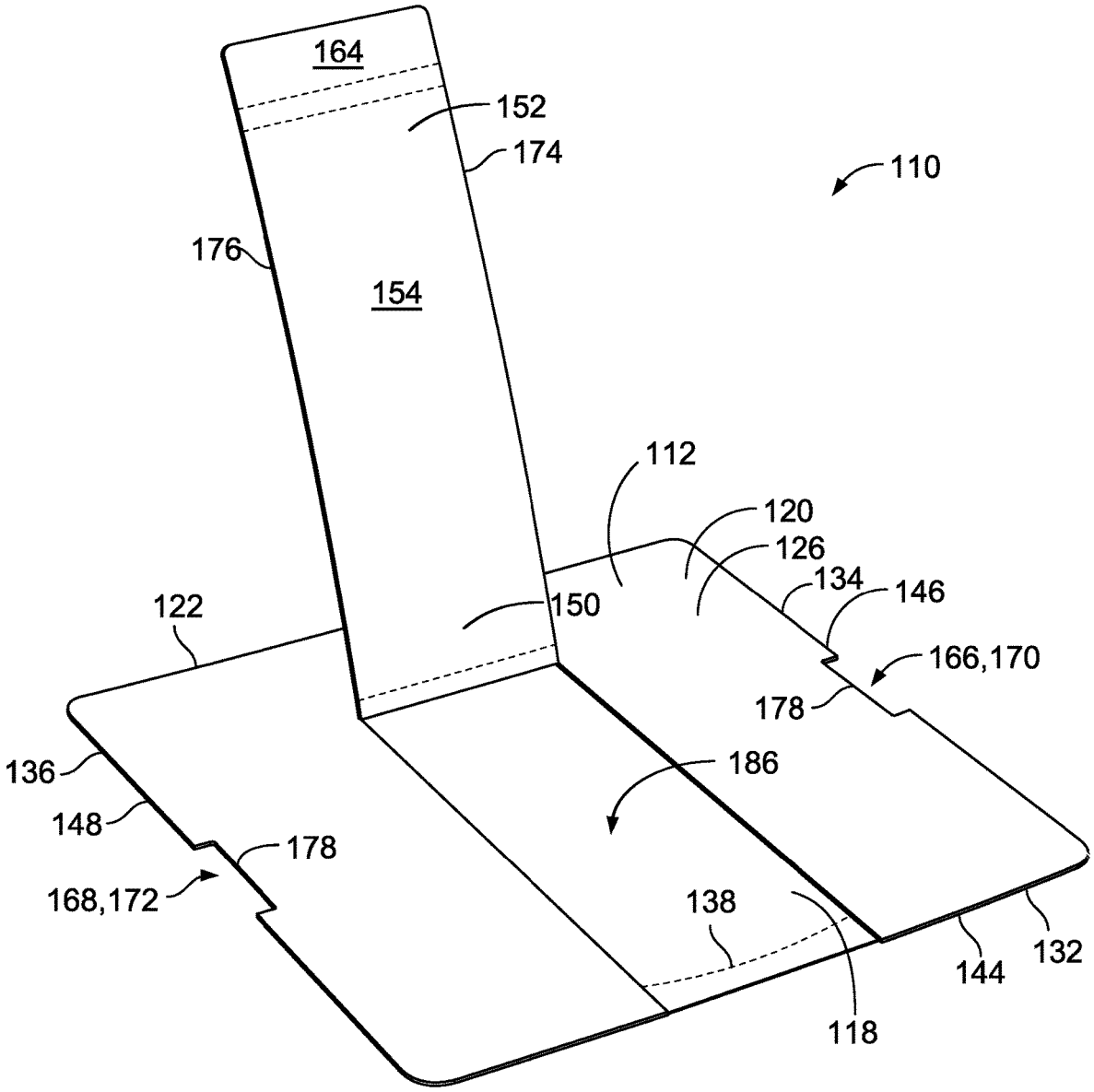
FIG. 3 illustrates an isometric view of the packaging device of FIG. 1 in an alternate partially assembled state.

FIG. 3 depicts the packaging device 110 having the arm 154 in an open position. When in the open position, the first and second perforated cut lines 156, 158 are ruptured so as to generate a first arm edge 174 and a second arm edge 176. The arm 154 may extend upward, away from the second portion 120, so as to define a product receiving or placement area 186. Although the arm 154 opens upward in the present embodiment, the arm 154 may open in any direction. For example, the arm 154 may detach from an area near the first fold line 122 and fold about a fold line adjacent to the second primary edge 144.

FIGS. 4-8 illustrate a packaging device assembly 108 including the aforementioned packaging device 110 and one or more products 190 retained therein. The product(s) 190 may be positioned between the arm 154 and the second outer surface 126 of the second portion 120, and, as a result, the arm 154 and the second portion 120 define a sleeve 188 configured to hold the product(s) 190. To provide additional security, a band 196 may wrap around the product(s) 190 and the first and second portions 118, 120, and may be disposed within each of the first, second, third, and forth notches 166, 168, 170, 172. The band 196 may be positioned either above or beneath the arm 154. In the present embodiment, the band 96 is made of a plastic material and may be transparent in order to avoid obscuring the product(s) 190 being retained in the packaging device 110; however, the band 196 can be made of any suitable material. The first, second, third, and forth notches 166, 168, 170, 172 may prevent the band 196 from sliding along the first, second, third, and fourth secondary edges 134, 136, 146, 148.

Further, in other embodiments, the band 196 may be completely omitted and the notches 166, 168, 170, 172 left unused or also omitted when manufacturing the packaging device assembly 108. It is also contemplated that other retention mechanisms may be provided with, or in lieu of, the band 196 to ensure the product(s) remain in position. For example, the product(s) may be directly attached to the packaging device by way of one or more of an adhesive, fasteners, hook and loop fasteners, or any other appropriate method. Additionally, multiple products may be attached to each other using one or more of the aforementioned methods so they remain oriented correctly. Furthermore, an additional retention mechanism may not be used at all in some embodiments.

Figure 6:
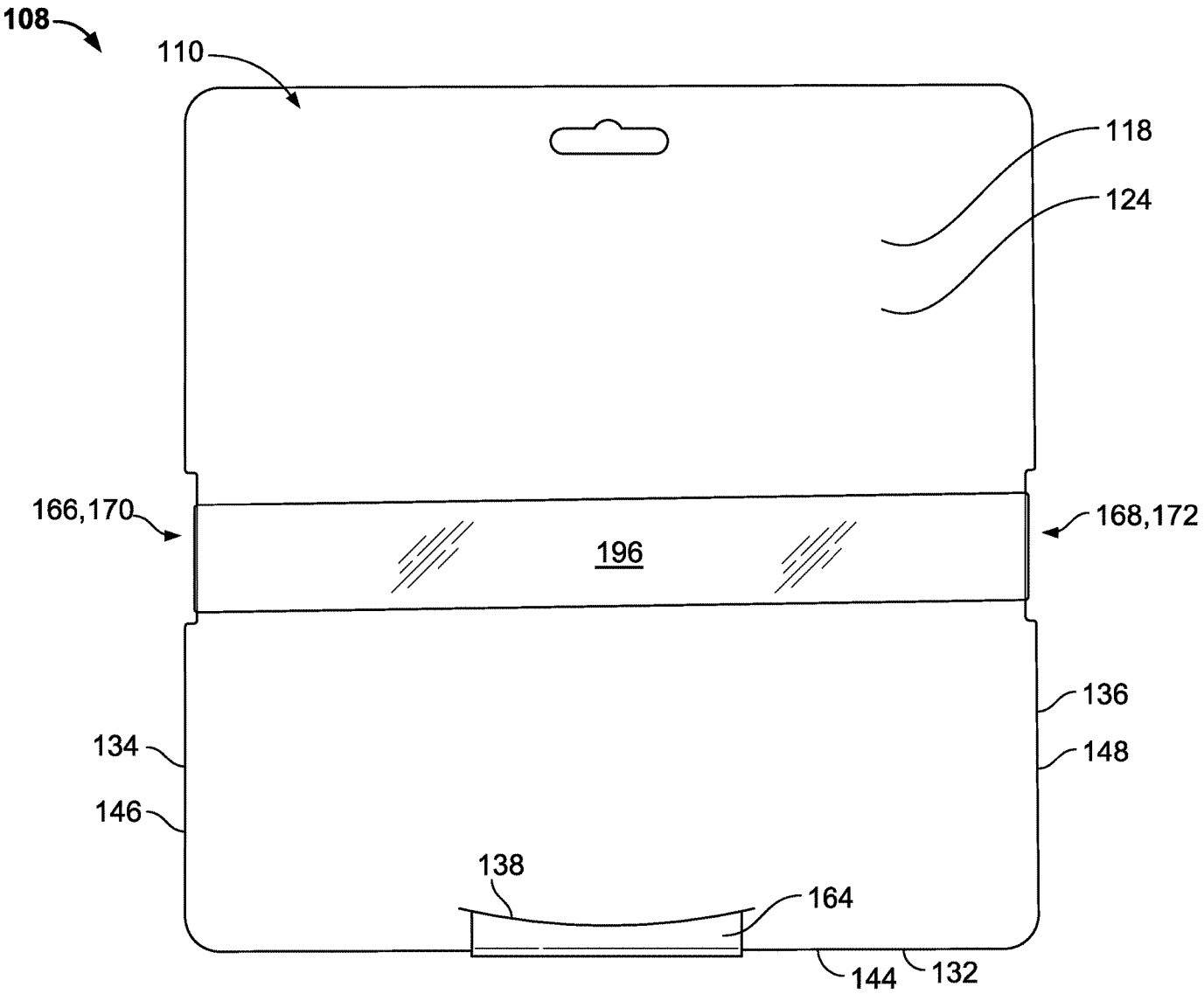
FIG. 6 illustrates a rear view of the packaging device assembly of FIG. 4.

When in an assembled position, the tab 164 of the arm 154 is folded about the first and second primary edges 132, 144 so that it sits adjacent to the first outer surface 124 of the first portion 118. FIG. 6 displays the tab 164 positioned within the attachment mechanism 138. As previously described, the attachment mechanism 138 of the present embodiment may be a perforated arcuate cut disposed adjacent to the first primary edge 132 of the first portion 118. Additionally or alternatively, the attachment mechanism 138 may embody different shapes or methods, such as adhesive or tape. Further, additional embodiments may have no attachment mechanism at all.

Figure 4:
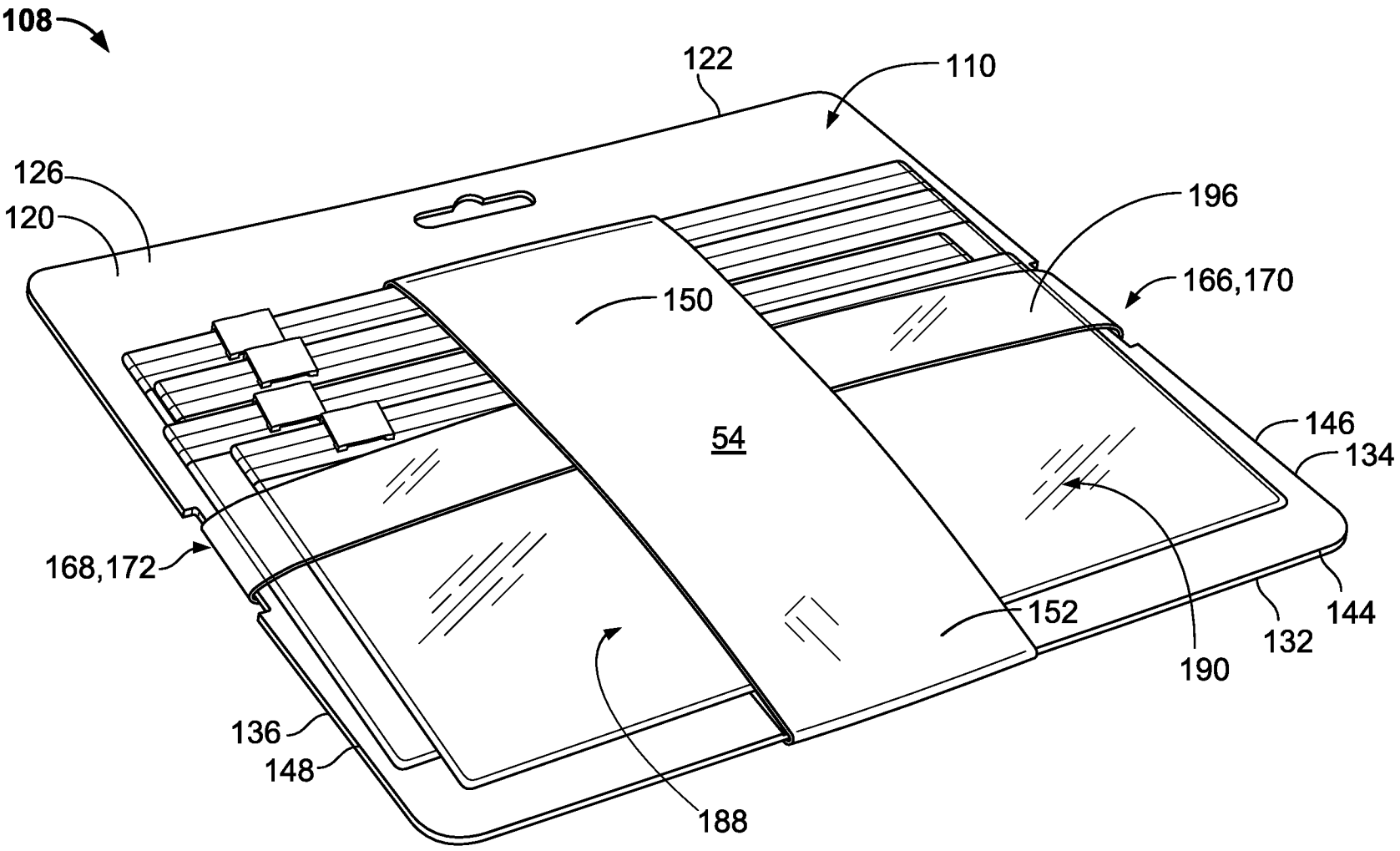
FIG. 4 illustrates an isometric view of a packaging device assembly in an assembled state.
Figure 5:
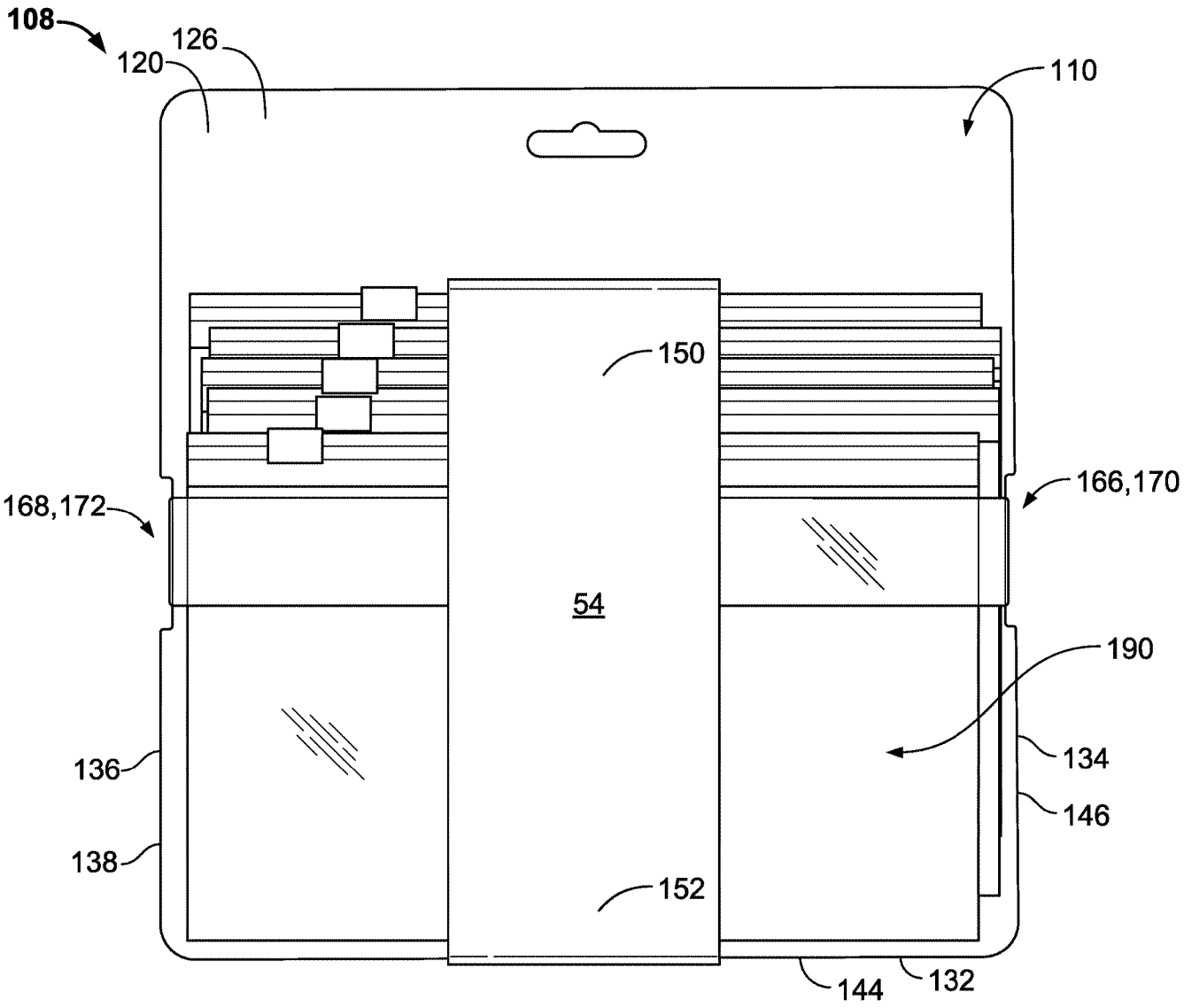
FIG. 5 illustrates a front view of the packaging device assembly of FIG. 4.
Figure 7:
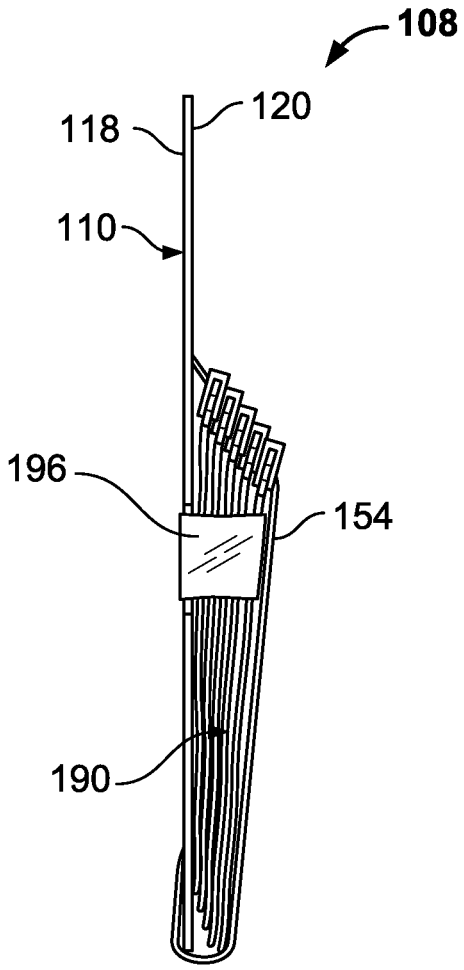
FIG. 7 illustrates a side view of the packaging device assembly of FIG. 4.

FIG. 7 shows a side view of the packaging device assembly 108 of FIGS. 4 and 5. As displayed, the products 190 contained within the packaging device 110 are folded in a predominantly flat position so that the arm 154 in a closed position is nearly returned to the original position; however, the packaging device 110 can be configured to accommodate products of thicker or varying dimensions. For example, the packaging device 110 can be designed with a longer arm so that the arm can wrap around a thicker product.

Figure 8:
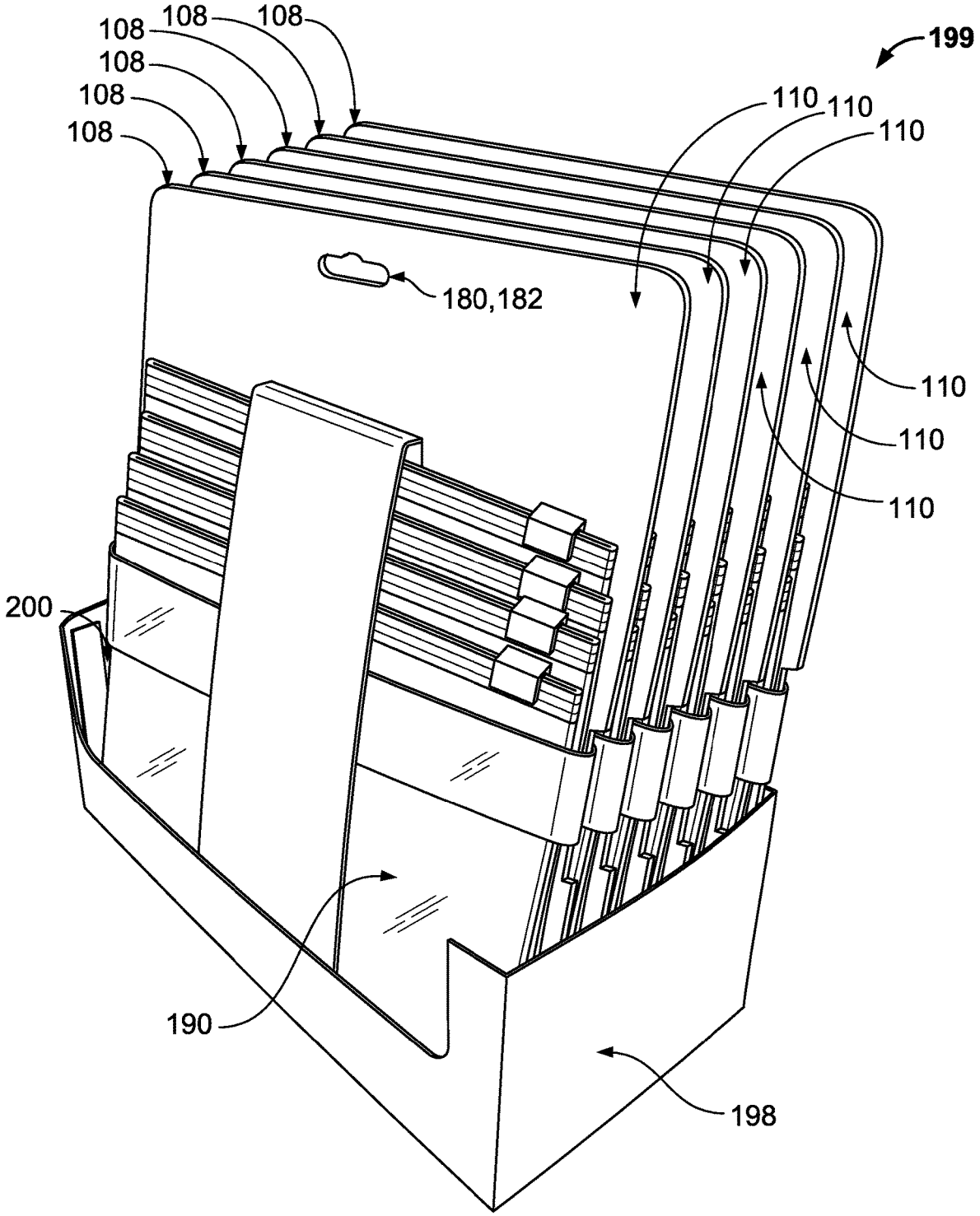
FIG. 8 illustrates an isometric view of a plurality of packaging device assemblies of FIG. 4 retained in a separate portion of packaging.

As previously mentioned, the packaging device 110 may include a scalloped slot formed from the cutouts 182, 184 to allow the packaging device 110 to hang from rack hooks or hangers; however, FIG. 8 illustrates an additional method for displaying one or more packaging device assemblies 108. In particular, a display assembly 199 may include a display tray 198 configured to retain and display a plurality of packaging devices 110. The display tray 198 may include slots 200 configured to retain each packaging device 110 in a predetermined position. Additionally, the slots may establish a set spacing between each packaging device 110, which can ensure each packaging device 110 is accessible. It is also contemplated that the slots may be straight-line or curved. The present embodiment depicts the display tray 198 holding six packaging devices 110 upright; however, the display tray 198 can be designed to accommodate any number of packaging devices 110 in a variety of positions.

Figure 9:
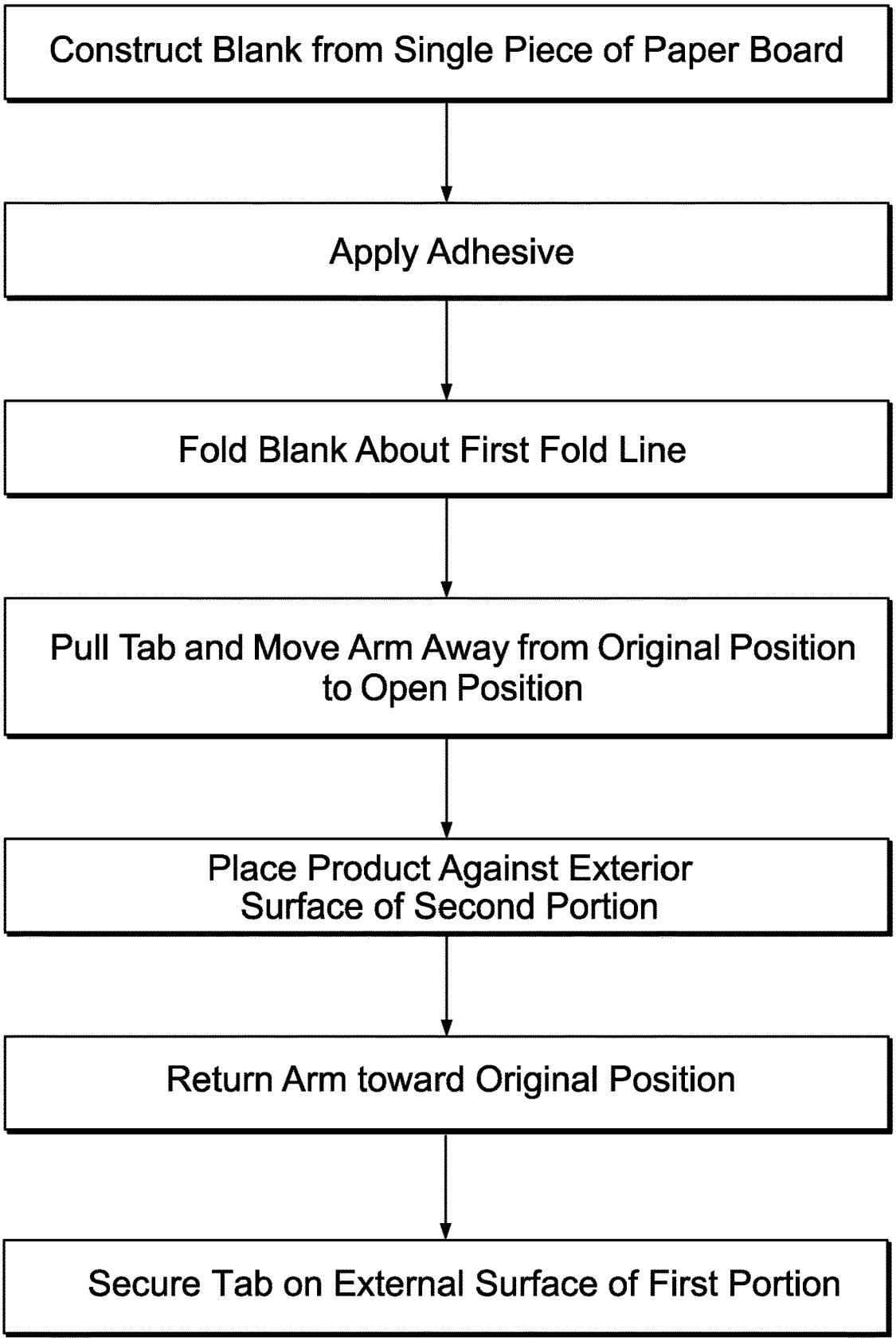
FIG. 9 illustrates a method of assembling the packaging device assembly of FIG. 4.

FIG. 9 illustrates a method for constructing the packaging device 110. First, the blank 112 may be prepared from a single piece of paper board. Alternatively, the blank may be constructed from a variety of materials, such as cardboard, plastic, rubber, or any other appropriate material. When the blank 112 is constructed, the features depicted in FIG. 1 and/or described above are provided. Specifically, the notches, perforated cut lines, cutouts, and attachment mechanism are created on the blank. After preparing the blank 112, adhesive is applied to designated regions on a second inner surface of the second portion. Then, the blank 112 is folded about the first fold line 122 so that the second inner surface with the adhesive contacts a first inner surface on the first portion. Once the adhesive is set, the packaging device 110 is ready to be assembled with a product. To attain the open position, the tab 164 is pulled away from the original position adjacent to the second primary edge 144 and the arm 154 is displaced from the second portion 120 by pivoting it about an arm fold line at its proximal end 150 so that the first fold line 122 is adjacent thereof, ultimately defining a product receiving or placement area 186 for the product to be placed against the second portion 120. After placing the product in the product receiving or placement area 186, the arm 154 is returned toward its original position until it reaches a closed position wrapping around the product. The tab 164 is then secured within the attachment mechanism 138, attaining an assembled position. Optionally, adhesive may be added to the tab 164 for additional security.

Figure 10:
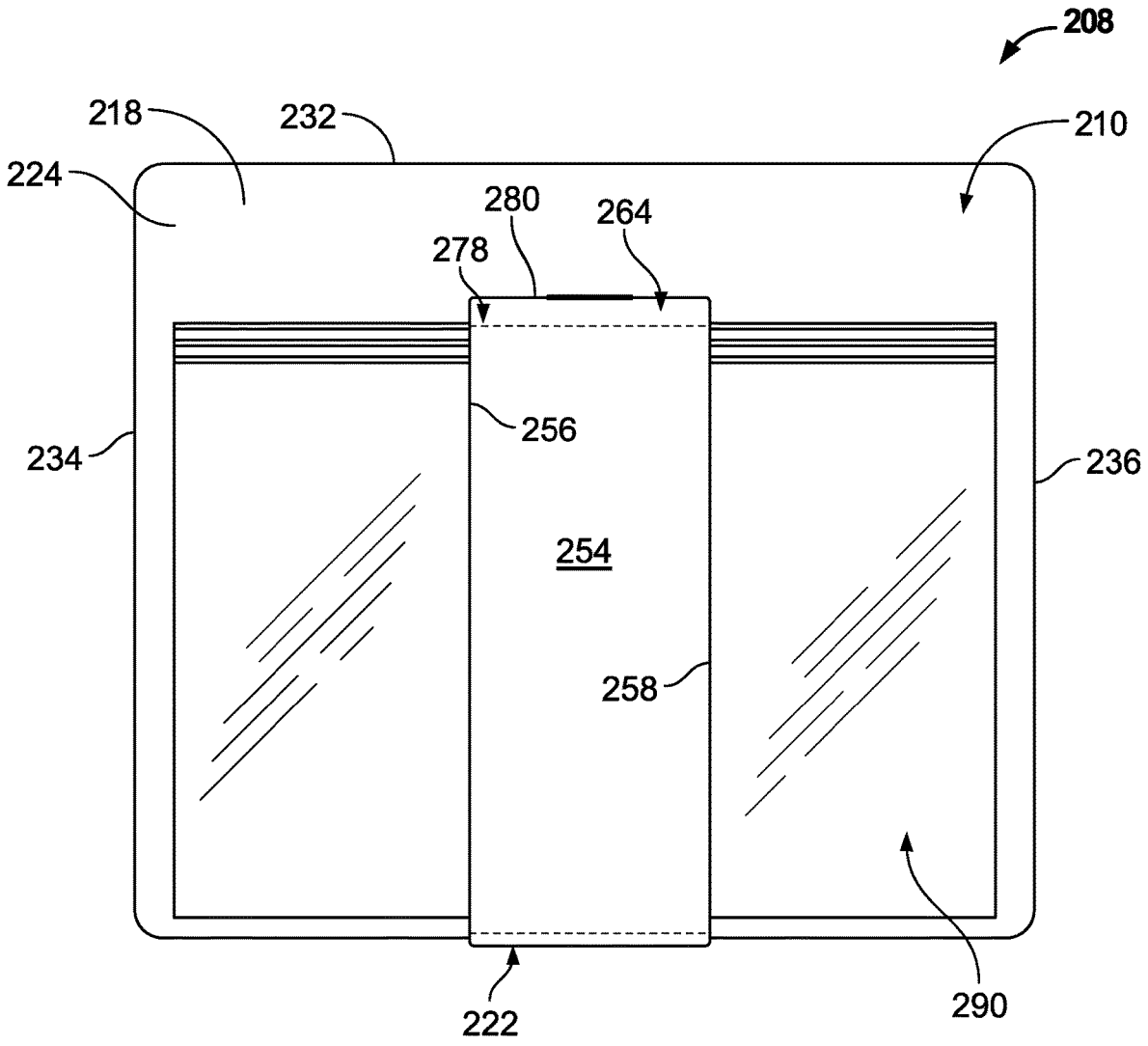
FIG. 10 illustrates a front view of another aspect of a packaging device assembly.

Turning now to FIG. 10, another packaging device assembly 208 is depicted. The packaging device assembly 208 is shown including a packaging device 210 and a product 290. The packaging device 210 may include a first portion 218 foldably connected to an arm 254 by way of a first fold line 222. The first portion 218 may include a front surface 224 and a first primary edge 232, the edge 232 substantially parallel and opposite the first fold line 222. First and second secondary edges 234, 236 may extend between the first fold line 222 and the first primary edge 232 and may be substantially perpendicular to the first fold line. The arm 254 may include first and second side edges 256, 258 substantially perpendicular to the first fold line 222. The arm 254 may further provide a tab 264 defined by an end edge 278 and a second fold line 280.

To assemble the packaging device assembly 208, the arm 254 begins in an original position. Then, the arm is displaced from the original position by pivoting about the fold line 222 until it is substantially displaced from the first portion 218. Once in the open position, a product 290 to be packaged is placed against the first portion 218 and the arm 254 is returned toward the original position until it reaches a closed position, wrapping around the product 290. The tab 264 is then folded about the second fold line 278 and secured with adhesive, a fastener, or another appropriate method of security.

Figure 11:
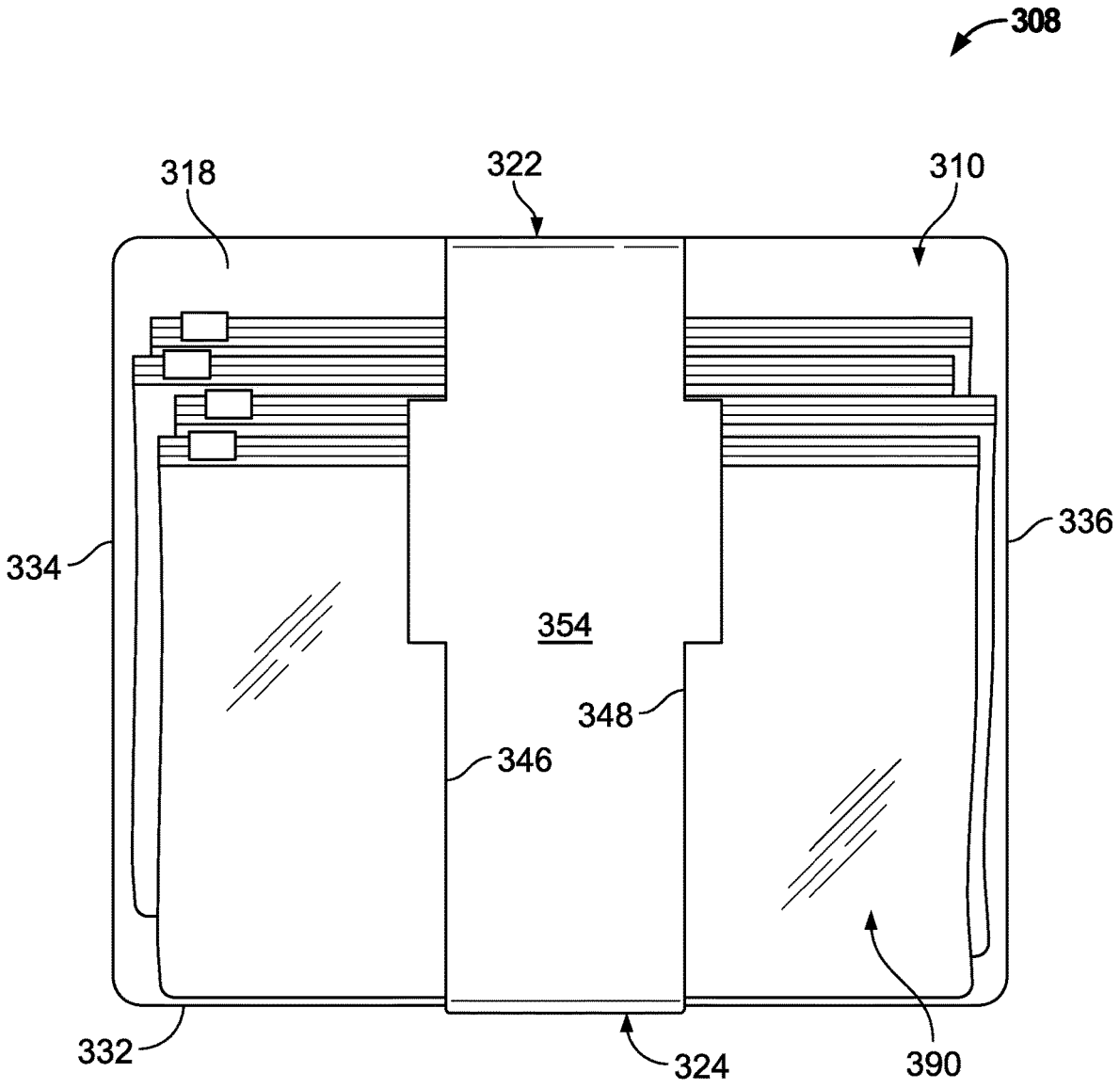
FIG. 11 illustrates a front view of yet another aspect of a packaging device assembly.
Figure 12:
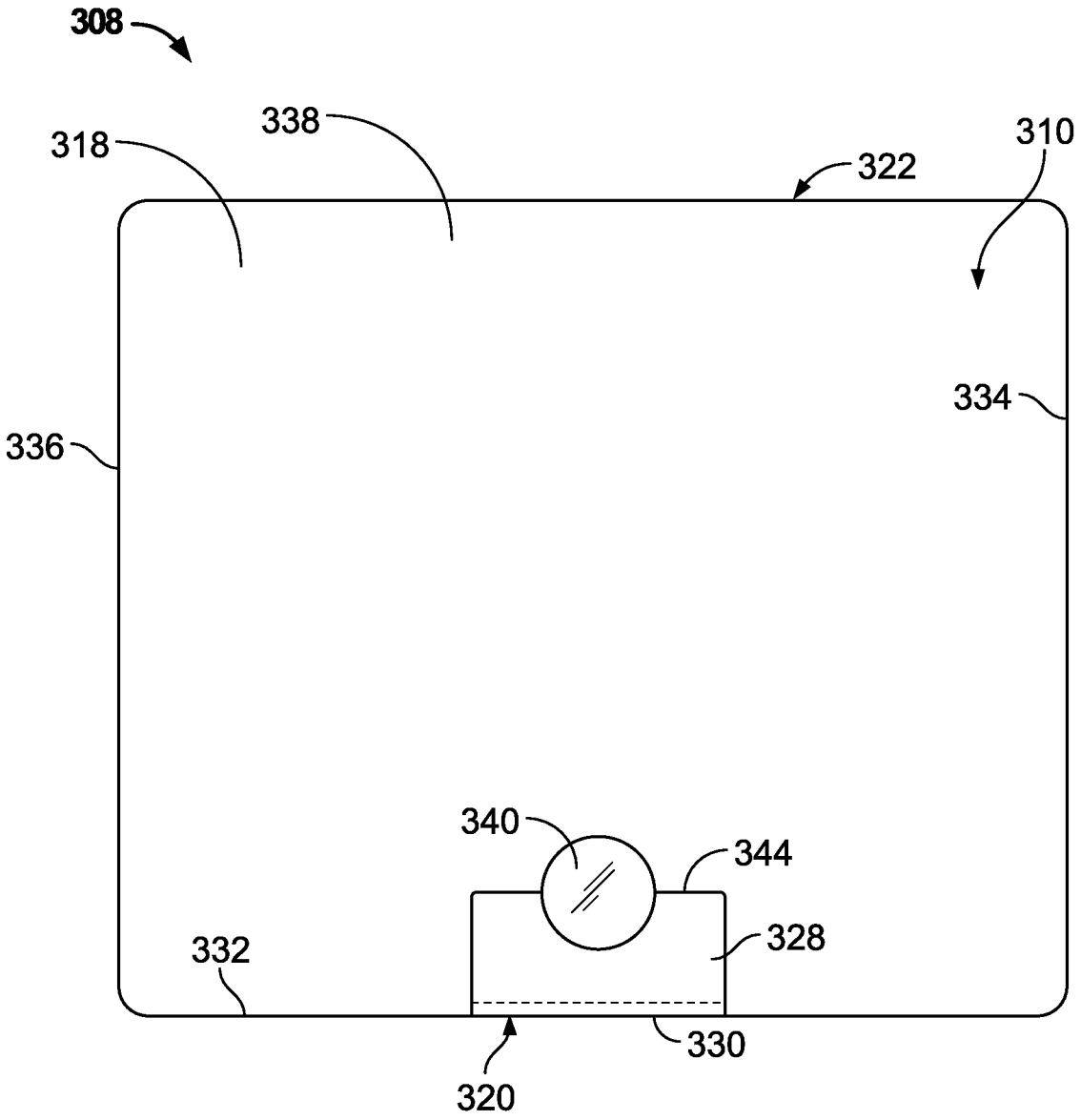
FIG. 12 illustrates a rear view of the packaging device assembly of FIG. 11.
Figure 13:
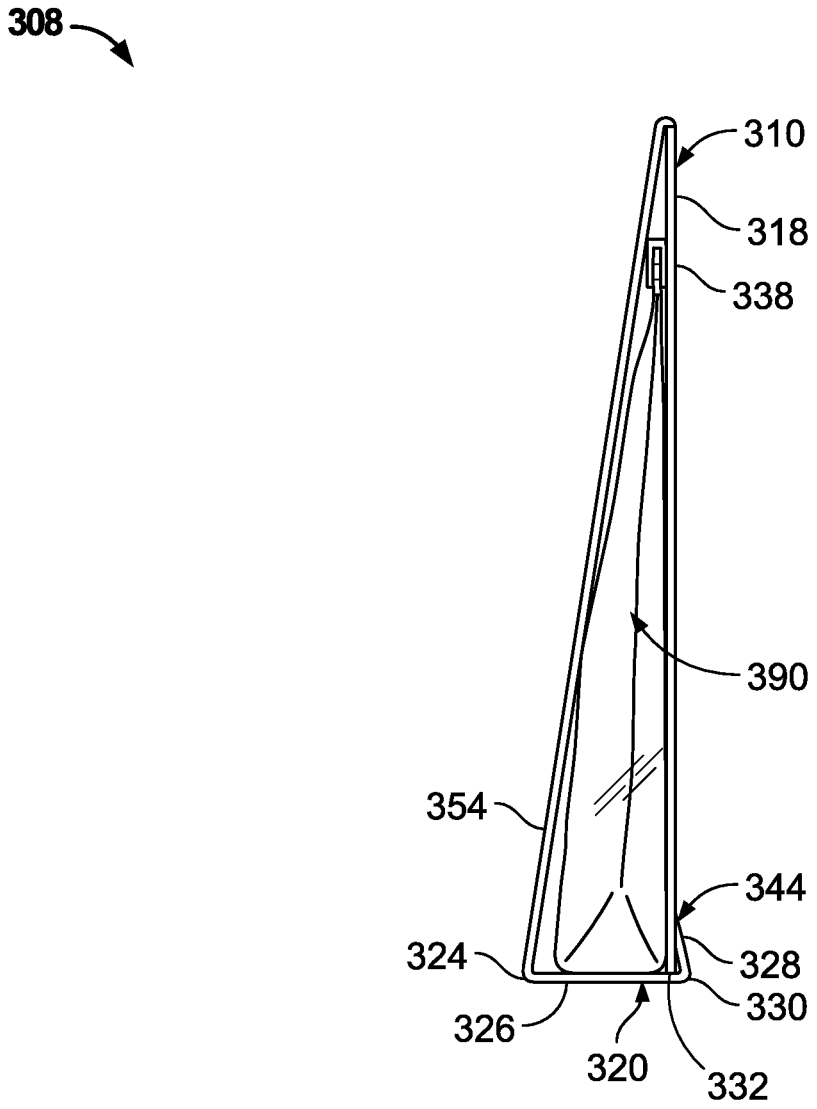
FIG. 13 illustrates a side view of the packaging device assembly of FIG. 11.

Turning now to FIGS. 11-13, still another packaging device assembly 308 is depicted. In this aspect, the packaging device assembly 308 is shown including a packaging device 310 and a product 390. The packaging device 310 includes a first portion 318 and an arm 354 foldably attached to the first portion 318 by way of a first fold line 322. The first portion 318 comprises a first primary edge 332 distal and substantially parallel to the first fold line 322, and first and second secondary edges 334, 336 substantially perpendicular to the first fold line 322. The arm 354 comprises third and fourth secondary edges 346, 348 substantially perpendicular to the first fold line 322 and a second fold line 324 distal and substantially parallel to the first fold line 322. Additionally, a base portion 320 is foldably attached to the arm 354 by way of the second fold line 324 and includes a first base panel 326 adjacent to the second fold line 324 and a second base panel 328 foldably attached to the first base panel 326 by way of a base fold line 330. The second base panel 328 further includes a second primary edge 344 distal and substantially parallel to the second fold line 324 (see FIGS. 12 and 13).

In an assembled position as shown in FIGS. 11-13, the base portion 320 extends from the second fold line 324 of the arm 354 to the first portion 318 so that the first primary edge 332 and the base fold line 330 are collinear. The second base panel 328 is positioned to contact the first portion 318, and the second primary edge 344 is secured to an external surface 338 of the first portion 318, e.g., by way of an adhesive sticker 340. Additionally or alternatively, the first portion 318 may include an attachment mechanism such as a notch into which the second base panel 328 may be inserted. Thus, when assembled, the first base panel 326 of the base portion 320 provides a flat surface for the packaging device 310 to sit on.

Figure 14:
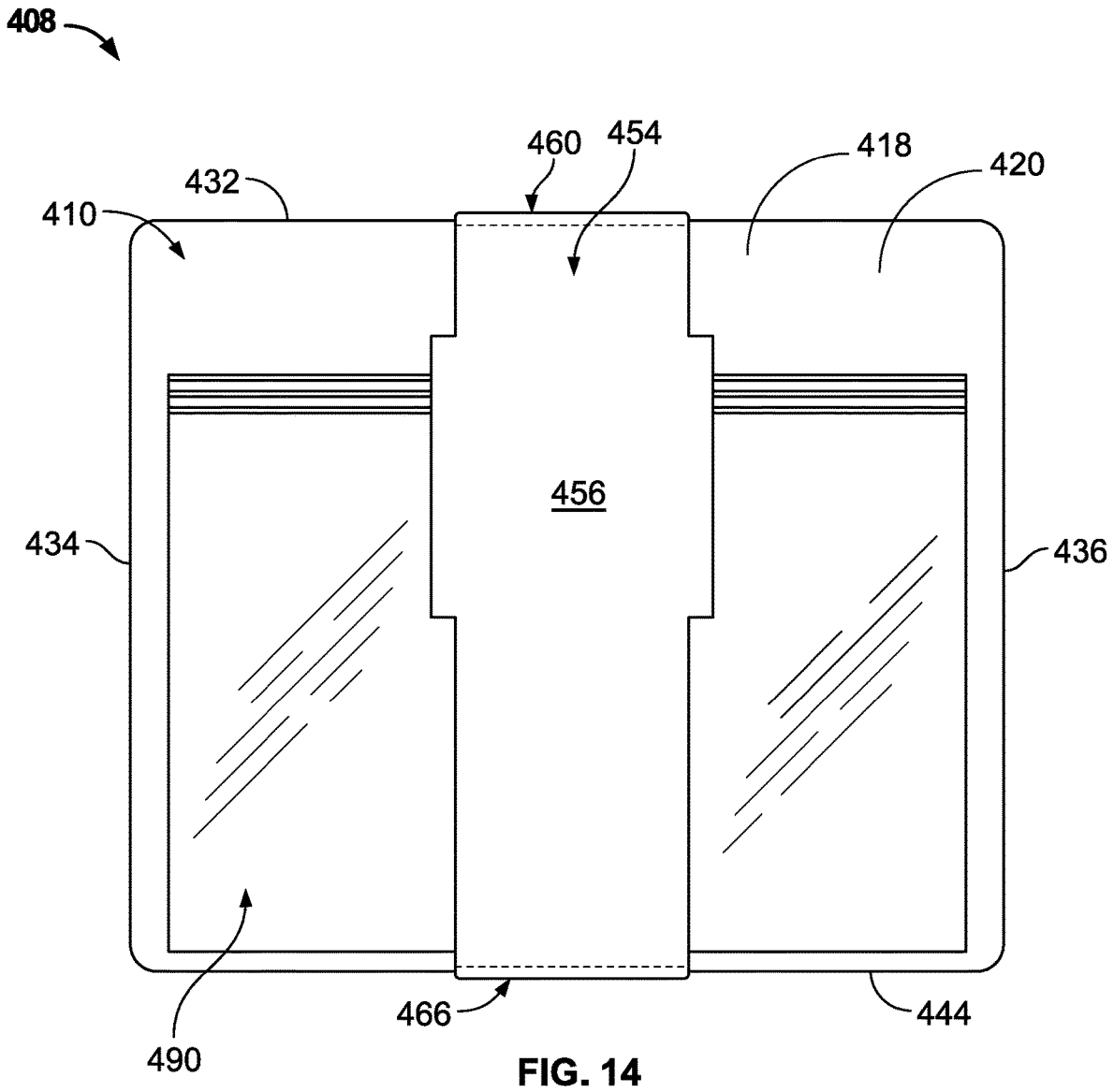
FIG. 14 illustrates a front view of still another aspect of a packaging device assembly.
Figure 15:
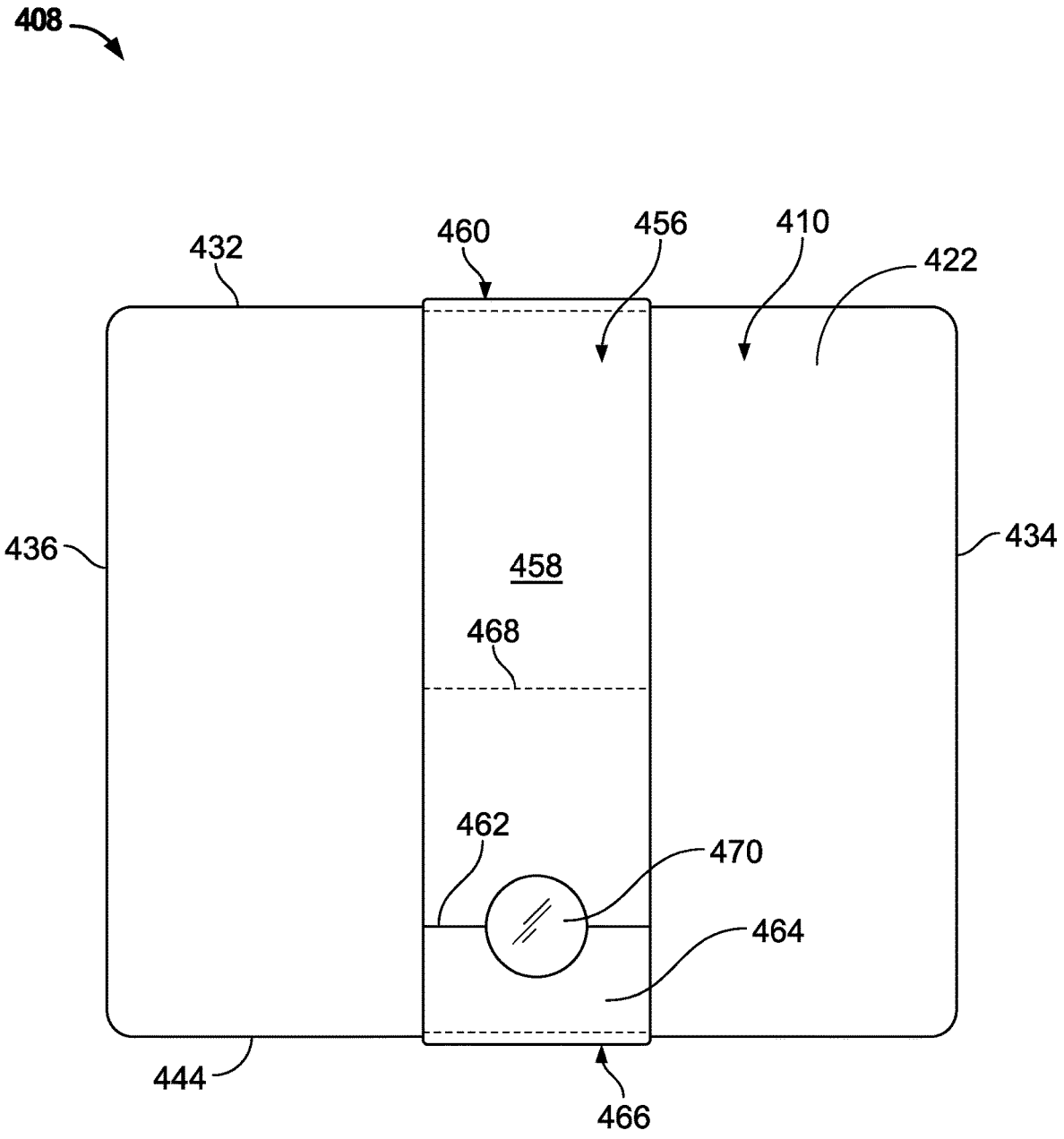
FIG. 15 illustrates a rear view of the packaging device assembly of FIG. 14.

FIGS. 14 and 15 illustrate yet another packaging device assembly 408 including a packaging device 410, a product 490, and a sleeve 454. The packaging device 410 includes a first portion 418 comprising a first primary edge 432, a second primary edge 444 substantially parallel to the first primary edge 432, a first secondary edge 434 substantially perpendicular to the first primary edge 432, and a second secondary edge 436 substantially parallel to the first secondary edge 434. Further, the sleeve 454 comprises a front panel 456 and a first rear panel 458 foldably attached to the front panel 456 by way of a first fold line 460, the first rear panel 458 having a first end edge 462 distal and substantially parallel to the first fold line 460. Additionally, a second rear panel 464 is foldably attached to the front panel 456 by way of a second fold line 466 that is distal and substantially parallel to the first fold line 460, the second rear panel having a second end edge 468 distal and substantially parallel to the second fold line 466.

In an assembled position as shown in FIGS. 14 and 15, the product 490 is placed on a front surface 420 of the first portion 418 and the arm 454 is positioned so that the front panel 456 sits adjacent to the product 490 and the first and second rear panels 458, 464 are folded about the first and second fold lines 460, 466, respectively, so that first and second rear panels 458, 464 contact a rear surface 422 of the first portion 418. In this position, the product 490 is positioned between the front panel 456 of the arm 454 and the first portion 418. Additionally, the first end edge 462 is secured to the second rear panel 464 with an adhesive sticker 470.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

We claim:

1. A packaging device, comprising:

a first portion; and a second portion connected to the first portion by way of a first fold line, wherein the first portion includes a first primary edge opposite the first fold line, wherein first and second secondary edges extend between the first fold line and the first primary edge, wherein the second portion includes a second primary edge opposite the first fold line, wherein third and fourth secondary edges extend between the first fold line and the second primary edge, wherein an arm is defined by two cut lines extending from a section of the second portion closer to the first fold line than the second primary edge, and ending in a tab that extends from a distal end of the second primary edge, and wherein, in a folded state, the first primary edge is aligned with the second primary edge, wherein the first primary edge and the second primary edge are parallel to the first fold line.

2. The packaging device of claim 1, wherein the arm is integrally formed with the second portion and further defines a living hinge.

3. The packaging device of claim 2, wherein the arm is defined by two perforated cut lines.

4. The package device of claim 1, wherein the first, second, third, and fourth secondary edges are perpendicular to the first fold line.

5. The packaging device of claim 1, wherein the first portion further includes an attachment mechanism that is provided adjacent the first primary edge, and wherein the tab is capable of being received by the attachment mechanism.

6. The packaging device of claim 5, wherein the attachment mechanism is a perforated cut line.

7. The packaging device of claim 6, wherein the perforated cut line is arcuate in shape.

8. The packaging device of claim 1 further including first and second notches provided along the first and second secondary edges of the first portion, respectively, and third and fourth notches provided along the third and fourth secondary edges of the second portion, respectively.

9. The packaging device of claim 8, wherein the first primary edge and the second primary edge are parallel to the first fold line.

10. The packaging device of claim 9, wherein the first, second, third, and fourth secondary edges are perpendicular to the first fold line.

11. The packaging device of claim 10, wherein the tab includes two side edges perpendicular to the second primary edge.

12. The packaging device of claim 11, wherein the tab includes an end edge parallel to the second primary edge.

13. The packaging device of claim 12, wherein the two cut lines extend collinearly to the side edges of the tab.

14. The packaging device of claim 1 retained within a tray having a plurality of slots, wherein each slot is configured to hold the packaging device upright.

15. A packaging device, comprising:

a first portion; and a second portion connected to the first portion by way of a first fold line, wherein the first portion includes a first primary edge opposite the first fold line, wherein first and second secondary edges extend between the first fold line and the first primary edge, and wherein an attachment mechanism is provided adjacent the first primary edge, wherein the second portion includes a second primary edge opposite the first fold line, wherein third and fourth secondary edges extend between the first fold line and the second primary edge, wherein an arm extends from a section of the second portion closer to the first fold line than the second primary edge, and ending in a tab that extends from the second primary edge, and wherein a length of the first portion measured from the first fold line to the first primary edge is equal to a length of the second portion measured from the first fold line to the second primary edge, wherein the first primary edge and the second primary edge are parallel to the first fold line.

16. The packaging device of claim 15, wherein the arm is integrally formed with the second portion and further defines a living hinge.

17. The packaging device of claim 16, wherein the arm is defined by two perforated cut lines through the second portion.

18. The packaging device of claim 17, wherein the tab includes two side edges perpendicular to the second primary edge and an end edge parallel to the second primary edge, and wherein the two perforated cut lines extend collinearly to the side edges of the tab.

19. A packaging device, comprising:

a first portion; and a second portion foldably connected to the first portion by way of a first fold line, wherein the first portion includes a first primary edge distal and parallel to the first fold line, first and second secondary edges perpendicular to the first fold line, first and second notches provided along the secondary edges, and a perforated arcuate cut adjacent to the first primary edge, wherein the second portion includes a second primary edge distal and parallel to the first fold line, third and fourth secondary edges perpendicular to the first fold line, and third and fourth notches provided along the secondary edges symmetric to the first and second notches about the first fold line, wherein the second portion further includes an arm defined by two perforated cut lines extending from a section of the second portion closer to the first fold line than the second primary edge, and ending in a tab that extends beyond a distal end of the second primary edge, the tab having two side edges perpendicular to the second primary edge and one end edge parallel to the second primary edge, wherein the two side edges are provided collinearly with the two perforated cut lines.

20. The packaging device of claim 19, wherein, in a folded state, the first primary edge is aligned with the second primary edge.

21. The packaging device of claim 19, wherein the arm is integrally formed with the second portion.

22. The packaging device of claim 19, wherein the tab is movable relative to the second portion and is configured to be received by the arcuate cut.

23. A packaging device, comprising:

a first portion; and a second portion foldably connected to the first portion by way of a first fold line, wherein the first portion includes a first primary edge distal and parallel to the first fold line, and first and second secondary edges perpendicular to the first fold line, first and second notches provided along the secondary edges, wherein the second portion includes a second primary edge distal and parallel to the first fold line, third and fourth secondary edges perpendicular to the first fold line, and third and fourth notches provided along the secondary edges symmetric to the first and second notches about the first fold line, and wherein the second portion further includes an arm defined by two perforated cut lines extending from a section of the second portion closer to the first fold line than the second primary edge, and ending in a tab that extends from a distal end of the second primary edge, the tab having two side edges perpendicular to the second primary edge and one end edge parallel to the second primary edge, wherein the two side edges are provided collinearly with the two perforated cut lines, Wherein the first portion further includes an attachment mechanism provided adjacent the first primary edge, and wherein the attachment is configured to secure the tab of the arm.

24. The package device of claim 23, wherein the attachment mechanism is a perforated cut line.

25. The packaging device of claim 23, wherein the arm is integrally formed with the second portion, and wherein the arm is movable relative to the second portion.

26. The packaging device of claim 25, wherein the tab of the arm is configured to be moved away from the second portion to define a product receiving area.

27. The packaging device of claim 23, wherein, in a folded state, the first primary edge is aligned with the second primary edge.

* * * * *